United States Patent [19]
Munroe
[11] 4,320,271
[45] Mar. 16, 1982

[54] AC SWITCH MECHANISM OF THE BALL CONTACT TYPE

[76] Inventor: Ronald G. Munroe, P.O. Box 317, Georgetown, S.C. 29440

[21] Appl. No.: 237,337

[22] Filed: Feb. 23, 1981

[51] Int. Cl.³ ..... H01H 13/28
[52] U.S. Cl. ..... 200/277; 200/284
[58] Field of Search ..... 200/277, 284, 240

[56] References Cited

U.S. PATENT DOCUMENTS

| | | | |
|---|---|---|---|
| 2,254,729 | 9/1941 | Bryant et al. | 200/277 |
| 2,831,073 | 4/1958 | Mason | 200/277 |
| 3,032,620 | 5/1962 | Silberg | 200/277 |
| 3,958,090 | 5/1976 | Garcia | 200/277 |

FOREIGN PATENT DOCUMENTS

| | | | |
|---|---|---|---|
| 656015 | 1/1963 | Canada | 200/277 |
| 864660 | 2/1971 | Canada | 200/277 |

OTHER PUBLICATIONS

Circle F Industries, Inc.; Catalog No. 22A, p. 74–Catalog #1888–L5.

*Primary Examiner*—Willis Little
*Attorney, Agent, or Firm*—Frederick A. Zoda; John J. Kane; Albert Sperry

[57] ABSTRACT

An AC switch mechanism utilizes a ball contact to which generally linear motion is imparted by a rockable actuator having a spring providing downward contact force and a spring acting ball pusher leg to provide a snap action. In a single pole configuration disclosed as a typical and basic embodiment of the switch, the ball contact in one extreme position engages and extends as a conductive bridging element between bared conductor wires of an electric cable. The cable thus dispenses with the need for assembling separately made switch terminals with the other components of the mechanism. When moved from the "on" position to its other extreme, "off" position, the ball moves onto sloping ramps having a slight, gradual inclination relative to the lengths of the conductor wires. The construction offers a slow break to provide a minimum arc length before the zero point of the AC cycle, a characteristic of great importance in the design and operation of AC switches. Further benefits are obtained by providing a simultaneous two-point break to divide the arc and therefore reduce the arc's outward extension and tracking of the adjacent areas. The design is additionally effective to produce a fast bounce, free make to minimize contact deterioration caused by arcing at the "make" point of the switching cycle. The need for silver alloy contacts is eliminated by providing a continuously moving point of arc termination which cools the contact surface, minimizing the volume of vaporized material, and condenses out the copper vapor during the zero point of the half cycle.

22 Claims, 8 Drawing Figures

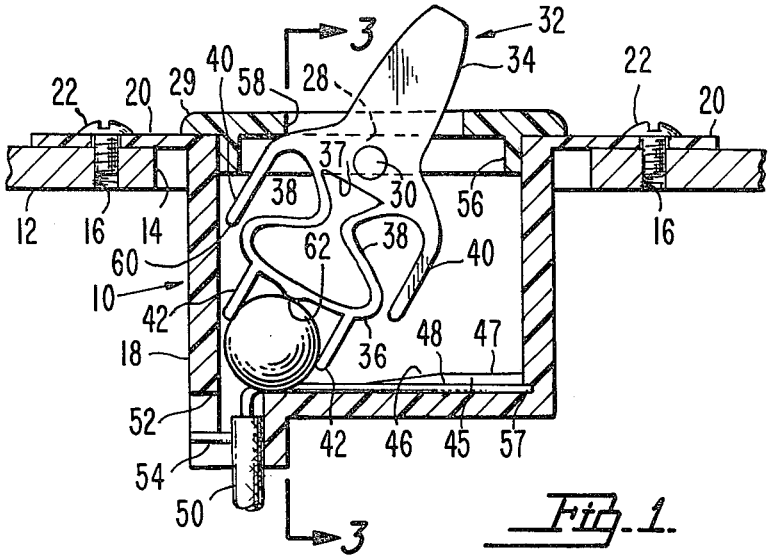
Fig. 1.
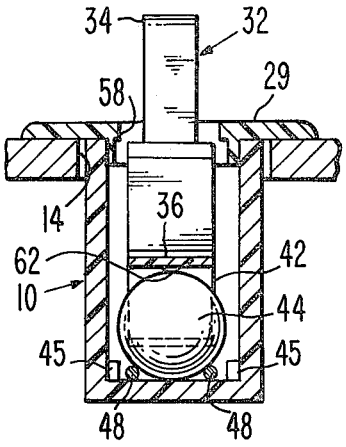
Fig. 3.
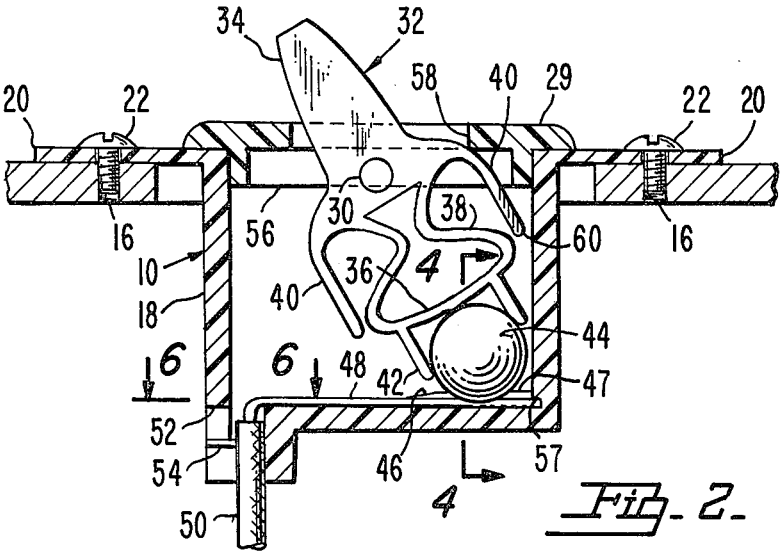
Fig. 2.
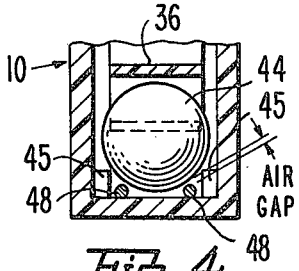
Fig. 4.
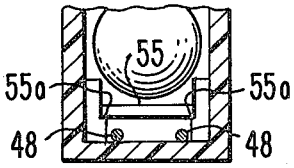
Fig. 8.
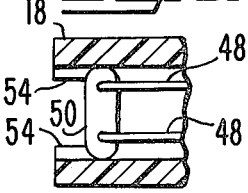
Fig. 6.
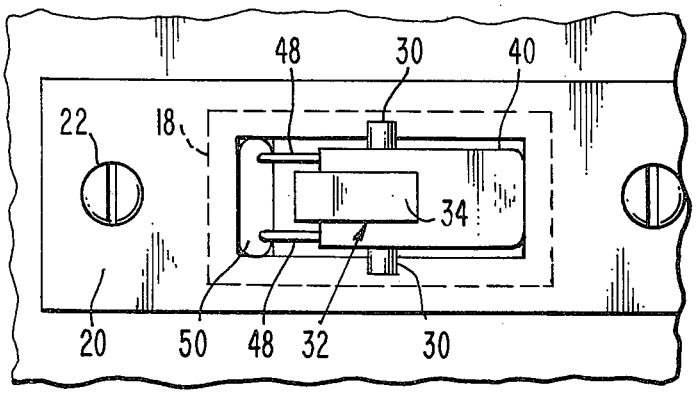
Fig. 5.
Fig. 7
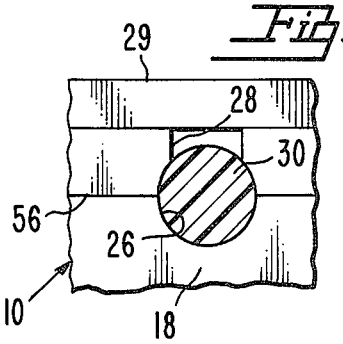

AC SWITCH MECHANISM OF THE BALL CONTACT TYPE

BACKGROUND OF THE INVENTION

1. Field of the Invention

The invention relates in general to switch mechanisms, and more particularly to snap switches in which a compression spring or the equivalent thereof moves over dead center, to bias a movable contact element in a generally linear path between make and break positions. In a more particular sense, the invention relates to switches wherein the movable contact element has a slow, double break, and a fast bounce free make.

2. Description of the Prior Art

A wide variety of AC switches has been provided for the market, for use as wall switches in residential and commercial buildings, appliance control switches, and so-called boxless switches used in manufactured homes, to state a few examples of locations and circuits in which switches of this type are commonly installed.

A switch of this type, desirably, should be capable of manufacture at extremely low cost, and should additionally possess many properties known to be highly desirable, and indeed in many cases necessary. Desirably, the switch should incorporate make and break actions which are known to be especially significant in AC circuits. The failure to incorporate these characteristics in an AC switch may in some instances require that the contacts be of heavy, highly expensive material. For example, it is a common practice to employ silver alloy contacts in AC switches, because typically, there is only a small contact area. In these circumstances a material possessing high electrical conductivity is needed to minimize melting or welding of the electrical contacts. It is true, also, that in the absence of a silver alloy contact, as for example where a brass contact is used, adverse electrical phenomena manifest themselves. For example, when brass contacts are employed, a brass vapor is produced in the arc almost inevitably resulting during the break portion of the switch cycle. Brass vapor does not cool quickly enough in half of an AC cycle to condense completely as does silver. As a result, "restrikes" occurring across the contact gap after separation of the contacts may occur. As a result, there may be a rapid deterioration of the switching function or other equally disastrous consequences.

It is also of major importance that an AC switch be capable of passing the stringent testing requirements of Underwriters Laboratories, as well as local, state, and national building codes and standards. Typically, these involve testing the switch for endurance and safe and efficient operation under both light and heavy loads, often with substantial inrush contents.

Also, temperature rise due to electrical resistance at the termination points must be controlled. To meet these exceedingly strict requirements, while yet achieving the equally important goal of permitting manufacture at low cost, has presented a dilemma to manufacturers. The problem they face is that compliance with electrical codes and other requirements can be readily achieved by use of highly expensive switch designs; it is equally easy to produce inexpensive switch designs that are incapable of meeting established, stringent safety and operational requirements. Providing a switch which is both inexpensive and will yet be designed for safe and long operation is a problem which, it is felt, has not yet been fully achieved in the prior art.

SUMMARY OF THE INVENTION

Summarized briefly, the present invention comprises a switch mechanism which in combination with the electrical conductors to which the switch would normally be connected, comprises three basic components; a housing, a handle, an over center spring means, and a ball contact. In the illustrated embodiment, a two-part housing of electrically insulative material is used. In some instances, a one piece housing may be sufficient. A handle is rockably mounted in the housing for movement between on and off positions. The handle in the illustrated embodiment is integrally molded with a compression spring member, although in some commercial embodiments a separate compression coil spring or flat leaf spring may be used to advantage. The handle receives, at the bottom of the housing, the electrically conductive ball contact. In one extreme position of the handle, the ball contact bridges and is in engagement with parallel, bare wire terminations on the electrical cable to which the switch is connected, so that the stripped ends of the cable become the switch terminals and contacts.

Upon throw of the handle to the off position, the flat spring acting arm loads up and snaps the ball over at about the half-way point of rotation. This spring arm action eliminates the possibility of "teasing" the ball at a critical contact break point, that is, the ball does not hang up, stop, or slow up to an extent that would affect the operation adversely. The gradual ramp slope provides a slow separation of the ball from the bare copper conductors. In the final position of the ball contact resulting from throw of the handle to the off position of the switch, the ball contact is positioned upon the insulative rails or ramps, with a substantial air gap between the ball contact and the wire terminations. The ramp rails are designed for example with one having a greater slope at the extreme off position so that the ball rotates slightly about its vertical axis. This provides a continuously different contact point on the ball with each cycle of operation.

When the handle is thrown again, to the on position, the ball contact is thrown off the ramp with a fast bounce, free make action in which it makes a smooth landing upon the wire terminations. The sloped portion of the ramp will wear away with thousands of switching cycles. This presents a continuously new portion of bare copper wire.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

FIG. 1 is a longitudinal sectional view through one possible embodiment of the switch, in which the handle and ball contact are in the on position of the switch;

FIG. 2 is a similar view in which the handle and ball contact are in the off position;

FIG. 3 is a transverse sectional view substantially on line 3—3 of FIG. 1;

FIG. 4 is a fragmentary, transverse sectional view substantially on line 4—4 of FIG. 2;

FIG. 5 is a fragmentary, top plan view of the switch with the cover removed;

FIG. 6 is a fragmentary, detailed, sectional view on line 6—6 of FIG. 2;

FIG. 7 is an enlarged, fragmentary sectional view showing the bearing means of the cover and body used to support the handle for pivotal movement; and FIG. 8 is a view like FIG. 4 showing a modified construction.

DESCRIPTION OF THE PREFERRED EMBODIMENT

Designated generally at 10 is an electrical switch constructed according to the present invention. In the illustrated embodiment, the switch is of the boxless type, adapted to be attached directly to a panel 12 of a manufactured home. It may be noted that this is merely one example of an environment in which the switch could be used. Alternatively, it may be used as an appliance control switch, or it may be employed as a conventional AC wall switch mounted within an outlet box, or alternatively, it may be used in any of various other locations in which AC current is supplied.

In the illustrated example, accordingly, no effort has been made to show details of the mounting means. I may in some instances provide a mounting means of the snap-in type, integral with the housing of the switch, or alternatively, I may employ a conventional mounting strap such as are used on residential wall switches. Still further, a mounting strap may be employed for installing the switch in an instrument panel provided upon a piece of electrical equipment. It is mainly important to note that the present application is directed toward the switch mechanism, rather than the means for mounting the housing, so that said means is illustrative only as one type of mounting that could be used if desired or necessary.

In any event, the panel 12 has an opening 14 adapted to receive the housing of the switch. In close proximity to opposite ends of the opening 14, there is shown, as one means for mounting the switch, threaded openings 16 formed in the panel 12.

The switch housing 18 is of rectangular configuration, and may advantageously be formed of a suitable thermoplastic material, by an injection molding process. It will be understood, however, that this is not critical to successful operation of the invention. It is possible, indeed, to use any of various thermosetting plastics, compression-molded to the desired configuration.

Housing 18 in the illustrated example is molded integrally with a flat mounting strap 20, the ends of which are apertured to receive mounting screws 22 threadedly engageable in openings 16 of panel 12.

In the illustrated example, the body of the housing is formed open, and in the opposite sidewalls thereof there are provided approximately semi-circular bearing recesses 26 (FIG. 7), cooperating with complementary bearing recesses 28 formed in an electrically insulative cover 29, to receive trunnions 30 integral with a molded plastic actuator 32 having a handle 34 from which the trunnions project laterally outwardly to mount the actuator for rockable movement between the opposite extreme positions thereof shown in FIGS. 1 and 2.

The actuator 32 is molded entirely in one piece in the illustrated example, to include the handle 34, the trunnions 30, and extending downwardly into the housing, an end portion 36 which is in the illustrated example comprises an integral compression spring formed upon the underside of the base 37 of the handle. The actuator 32, as will be understood, will be preferably injection molded to include resiliently yielding side portions or spring elements 38 which, as shown in FIG. 1, are formed with reentrant angles opening outwardly, whereby the spring elements 38 are formed as identical but opposite, outwardly facing V's each of which is integral at one end with the handle base 37 and at its other end with the distal end portion 36 of the spring means constituted by said member 36 and the spring elements 38.

Projecting outwardly from and integral with the distal portion 36 are ball retainer members 42 in embracing relation to a ball contact 44. The ball contact 44 can be formed of brass or other material having good electrical conductivity, and in some instances, it may be desired to silverplate the ball contact to improve even more the electrical characteristics thereof.

The ball contact 44, in the off position of the switch shown in FIG. 2, rests upon transversely spaced raised ribs 45 which in the illustrated example, and preferably, are molded integrally with the housing. The ribs 45 include, adjacent the mid-point of the ball contact movement between its on and off positions shown in FIGS. 1 and 2 respectively, ramp portions 46 slope gradually in respect to transversely spaced, parallel stripped ends 48 of a two-conductor wire 50. The stripped ends 48, in the illustrated embodiment, serve as the stationary contacts of the switch mechanism, being bridged in the on position of the switch by the ball contact as shown in FIGS. 1 and 3. The wire ends further serve, howver, as part of the electrical wiring which connects the switch in circuit with a source of power and with the electrical products controlled by operation of the switch mechanism. Thus, it is possible to dispense with the usual, separately made terminals and stationary contacts, which require the use of additional expensive sheet or strip material, must be formed in dyes, and assembled with the other switch components in the switch housing.

The stripped ends extend from the usual electrically insulative sheaths and in the illustrated example this can be conventional cable used for residential or commercial wiring and known to the trade as "Romex" cable.

The stripped ends and the cable can be secured in place in any of various ways. As one example, I have illustrated the use of abutments 54 molded integrally on the opposite walls of an opening 52 provided at one end of the base of the housing as an entry area for the stripped ends of the cable. The stops engage the sheath material, holding it in place. The stripped ends, further, are secured in placed in the base of the housing, and may as shown be engaged at their distal ends under cuts 57 formed in the housing end wall opposite from that in which the cable entry 52 is provided. Thus the stripped ends extend the whole length of the base of the housing, and are firmly engaged therein, as straight, parallel rails bridged by the ball contact, and along which the ball contact may roll during its movement between the on and off positions of the switch.

The stripped or bared ends of the cable can also be secured by snapping them into place in grooves, not shown, formed in the base of the housing, it being mainly important that the wire ends project above the base sufficiently to make good contact with the ball element in the manner shown in FIG. 3.

The wire terminations 48 extend, again as shown to particular advantage in FIG. 3, in closely spaced, parallel relation to the respective, raised ribs 45, to provide a smooth transfer of the ball contact from the wire terminations to the ramp portions 46 when the ball is moving from its on to its off position. Instead of the "air gap" shown a barrier insulating separating wall 55 could be provided between the conductors and the ball, as shown in FIG. 8. This may be a molded part of the housing, but if this is not feasible, from the standpoint of mold design or cost, it can be a fiber insert, resting on longitudinal ledges provided along the inner side surfaces of the ribs 45. The barrier can begin at or about the high points of ramps 46 so that the ball will ride up over the barrier. The barrier can extend so that it will be between the ball and the conductors when the switch is in its off position.

It will be understood that the housing can be made in any of various ways, wither as one piece, or two pieces as shown. The mounting yolk or strap 20 may or may not be integral with the housing, and it may be possible, in some instances, to eliminate the cover 29. Indeed, some switch housings are provided with an integral cover portion, and are assembled upside down, with the base portion being ultimately closed by a separately molded bottom or, for that matter, by a simple stamped piece of fiber. These arrangements are well known in the art, and are believed sufficiently obvious as not to require special illustration. In the illustrated example, the cover 29 is provided with a depending flange 56 extending into the housing, and secured fixedly in place by ultrasonic welding means. Or, of course, other means such as rivets or other fasteners can be used for this purpose. The cover is provided with a handle opening 58. To provide a quiet switch, the handle opening is sized in such a fashion as to not engage the switch handle when the switch is thrown. Rather, within the switch housing the actuator is provided with integral, molded, slightly flexible stops 40 in the form of elongated flat walls or arms projecting from the base 37 at opposite sides of the spring means 36, 38. These have free distal end portions 60 which, as shown in FIGS. 1 and 2, engage the respective end walls of the switch housing when the actuator is operated between its respective, opposite extreme positions. In this way, the stops 40 provide limits for the travel of the handle, to prevent the handle from loudly striking the ends of the opening 58 provided in the corner. The incorporation of a slight flexibility in the stops 40 also aid in providing the snap action desirable in a switch of this type, and further serve to quiet the switch.

Operation

Since the switch is designed as an "AC only" switch device, it is important to provide for a slow contact separation for zero AC current switching with a minimum arc. To this end, it may be observed that in the on position of the switch, the ball contact extends as a bridging element between the wire terminations 48. When the handle is thrown from the FIG. 1 to the FIG. 2 position, the spring elements 38 will be caused to compress, while biasing the ball contact along the wire terminations. To minimize contact between the ball element and the portion 36, a molded point or projection 62 is provided on the underside of the portion 36 and comprises the only part of the portion 36 that is in actual contact with the ball.

As the spring arm loads up and forces the spring means over dead center, the ball contact will be biased along the wire terminations 48. Once the ball starts moving in a linear path, it continues to the opposite end by the action of the loaded spring arm. The gradual slope of the ramps 46 causes the slow separation of the ball in a direction at right angles to the conductors. These, as previously noted, are at a very slight angle to the lengths of the terminations 48. As a result, there is a slow, gradual separation of the ball contact from the wire terminations even though the ball travels rapidly in the linear direction. This separation occurs simultaneously at both points at which the ball engages the wire ends.

The slow separation in and of itself produces the desirable electrical result of a minimum arc. This is highly desirable in any switch, to lengthen contact length, adapt the switch to meet stringent requirements and hence facilitate its listing and approval by Underwriters Laboratories or other associations, and withal, permit the switch to be manufactured at relatively low cost by eliminating the need for expensive contact materials and special plating.

Of importance, in this regard, is the fact that at the time the ball contact slowly disengages from the wire terminations, it does so with what is known in the industry as a "double break". This means that the separation occurs at two separate points, simultaneously. By moving out of engagement with both wire ends at the same time, the ball contact divides the arc, producing separate air gaps or passing over the insulating barrier 55 in such a way as to locate the barrier between the ball and the conductors at two separate points, that is, between the ball and each of the two conductors adjacent or at the break points, a feature considered highly desirable in the operation of AC switches.

As the handle continues its movement from its FIG. 1 to its FIG. 2 position, the ball contact rides fully up on to the ledge portions 47 of the ribs 45, to the rest position shown in FIGS. 2, 4, and 7. Distinct air gaps or insulating barriers now appear between the ball contact and both wire terminations as shown in FIGS. 4 and 7 respectively.

During its final movement to the off position, the ball contact picks up speed, not only because it is moving away from the dead center position while traveling in a generally linear path, but also because the ledge portions 46, being transversely spaced apart a distance greater than the wire terminations 48 (note FIG. 4) act upon smaller diameters of the ball than do the wire ends. The ball rotation is thus accelerated once it has made its slow break from engagement with the wire ends. This presents a cooler surface to the arc. The fast bounce-free make is provided by the fact that the ball lands on the conductors from an almost parallel direction rather than a normal direction as is the case with most switches heretofore known.

While the particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A switch comprising:

(a) a housing of electrically insulative material having a contact support wall;

(b) stationary electrical contact means supported upon and extending along said wall;

(c) contact-supporting rib means on said wall having ramps inclined at a slight angle in respect to said stationary contact means;

(d) a ball contact movable along said wall from a first, "on" position in which it engages the stationary contact means and a second, "off" position in which it leaves the stationary contact means via said ramps and comes to rest upon the rail means in spaced relation to the stationary contact means; and (e) actuator means movably mounted in the housing for biasing the ball contact between the "on" and "off" positions thereof.

2. A switch as in claim 1 wherein the stationary contact means comprises a pair of elongated, parallel, conductive rails, the ball contact extending in bridging relation to said rails.

3. A switch as in claim 2 wherein the rails are the stripped ends of an electric cable.

4. A switch as in claim 2 wherein said rib means comprises a pair of ribs electrically insulative material extending in parallel relation to said rails, said ball contact extending in bridging relation to and being supported upon said ribs.

5. A switch as in claim 4 wherein the distance across the locations at which the ball contact engages the ribs is greater than the distance across the locations at which the ball contact engages said rails.

6. A switch as in claim 4 in which the ribs are formed with ledge portions receiving the ball contact in the "off" position of the switch, each of said ribs including a ramp portion extending in close proximity to one of said rails.

7. A switch as in claim 6 wherein the rails are disposed between the ribs.

8. A switch as in claim 7 wherein the distance between the points of engagement of the ball contact with the ribs is closer to the length of the ball contact diameter than is the distance between the points at which the ball contact engages the rails.

9. A switch as in claim 6 wherein the actuator means moves across dead center when biasing the ball contact between said "on" and "off" positions.

10. A switch as in claim 9 wherein the actuator includes a handle and compression spring means interposed between the handle and the ball contact.

11. A switch as in claim 10 wherein the spring means in integral with the handle.

12. A switch as in claim 11 wherein the handle and spring means are of molded plastic material.

13. A switch as in claim 12 wherein the spring means comprises an end portion engaging the ball contact and a pair of resiliently yieldable spring elements connecting the end portions to the handle.

14. A switch as in claim 13 wherein the spring elements are respectively formed approximately to a V shape.

15. A switch as in claim 14 wherein the V shaped elements open outwardly from each other.

16. A switch as in claim 10 wherein the actuator further includes flexible stops integral with the handle at opposite sides of the spring means and adapted to engage respectively opposite walls of the housing when the handle is operated between said "on" and "off" positions.

17. A switch as in claim 16 wherein said spring means is V-shaped and wherein said spring stops load up against the "V" shaped spring means to force it past dead center during actuation.

18. A switch as in claim 16 wherein the flexible stops are formed as plastic arms molded integrally with the handle and having distal ends that engage the walls of the housing to flex the arms and thereby promote quiet operation of the switch.

19. A switch as in claim 18 in which said arms force the spring to bias the ball past dead center.

20. A switch as in claim 2 wherein at least one of the ramps and actuator means respectively, is designed to impart a slight rotation of the ball about its vertical axis, whereby a continuously new contact surface on the ball presents itself to the conductor rails.

21. A switch as in claim 20 wherein the ball contacts a different, new, part of each of the conductors responsive to wear of the ramps.

22. A switch as in claim 2 further including electrically insulative barriers disposed between the ball and the rails in the "off" position of the ball contact.

* * * * *

UNITED STATES PATENT AND TRADEMARK OFFICE

CERTIFICATE OF CORRECTION

PATENT NO. : 4,320,271

DATED : March 16, 1982

INVENTOR(S) : Ronald G. Munroe

It is certified that error appears in the above-identified patent and that said Letters Patent are hereby corrected as shown below:

Column 1, line 56, change "contents" to --currents--

Column 3, line 67, delete "is"

Column 5, line 45, change "corner" to --cover--

Signed and Sealed this

*Tenth* Day of *August 1982*

[SEAL]

*Attest:*

GERALD J. MOSSINGHOFF

*Attesting Officer*

*Commissioner of Patents and Trademarks*